US005875949A

United States Patent [19]

Hevenor

[11] Patent Number: 5,875,949

[45] Date of Patent: Mar. 2, 1999

[54] APPARATUS FOR RETAINING SHEET MATERIAL AS IT IS ADVANCED OUT OF A PROCESSING APPARATUS

[75] Inventor: Charles M. Hevenor, Glastonbury, Conn.

[73] Assignee: Gerber Scientific Products, Inc., Manchester, Conn.

[21] Appl. No.: 714,942

[22] Filed: Sep. 17, 1996

[51] Int. Cl.[6] ..... B65H 23/18; B43L 13/00

[52] U.S. Cl. ..... 226/39; 226/102; 33/18.1

[58] Field of Search ..... 226/38, 39, 102, 226/119, 118, 195; 33/18.1, 26, 32.5, 32.6

[56] References Cited

U.S. PATENT DOCUMENTS

| | | | |
|---|---|---|---|
| 4,561,581 | 12/1985 | Kelly | 226/118 |
| 4,835,872 | 6/1989 | Perezet et al. | 33/18.1 |
| 4,856,197 | 8/1989 | Auer et al. | 33/18.1 |
| 4,949,466 | 8/1990 | Auer et al. | 33/18.1 |
| 5,005,296 | 4/1991 | Gerber | 33/18.1 |
| 5,012,584 | 5/1991 | Galon et al. | 33/18.1 |
| 5,182,861 | 2/1993 | Suzuki et al. | 33/18.1 |
| 5,195,690 | 3/1993 | Cross et al. | 226/118 |
| 5,383,277 | 1/1995 | Shimoda et al. | 33/18.1 |
| 5,456,012 | 10/1995 | Therond | 33/18.1 |

OTHER PUBLICATIONS

Cox; 5,447,296; Sep. 1995; 226/118.
Pendleton; 3,189,928; Jun. 1965; 226/102.

*Primary Examiner*—Charles A. Marmor
*Assistant Examiner*—Matthew A. Kaness
*Attorney, Agent, or Firm*—McCormick, Paulding & Huber

[57] ABSTRACT

A processing apparatus for performing work operations on a sheet material includes a frame, and an advancing mechanism for feeding the sheet material through the apparatus. Additionally, an elongated tool head support is provided on the frame carries a tool head which moves along the support's length during a work operation. A retaining device such as, a magnetic or spring actuated clamp is also attached to the frame for retaining the sheet material as it is fed out of the processing apparatus. The use of the retaining device combined with the advancement of the sheet material causes the formation of a vertical loop in the material. The vertical loop causes the speed at which the advancing material approaches the floor or other horizontal surface to be reduced, thereby causing a concomitant reduction in the impact force of the sheet material with the floor. In addition, the vertical loop formed by the retained sheet provides a cushioning effect, further reducing the generated impact force. Accordingly, shock waves generated in the sheet material as a result of the impact with the floor are minimized.

10 Claims, 4 Drawing Sheets

APPARATUS FOR RETAINING SHEET MATERIAL AS IT IS ADVANCED OUT OF A PROCESSING APPARATUS

FIELD OF THE INVENTION

The present invention relates generally to the processing of a sheet material, and deals more particularly with an apparatus for preventing sheet material kinking and backup as the sheet material is advanced out of a processing apparatus.

BACKGROUND OF THE INVENTION

The present invention has particular utility in connection with the prevention of shock waves in sheet materials as well as in preventing sheet material backup as the material is advanced out of a processing apparatus, and is described herein as applied to such use.

Material processing apparatus such as, drum plotters typically operate by performing work operations on elongated sheets of material fed from a roll. In known plotters, a tool carrying tool head is mounted on an elongated support located above and extending across the elongated sheet of material. The tool head moves in one (y) coordinate direction back and forth across the support's length as the sheet of material itself is advanced by the plotter in another (x) coordinate direction perpendicular to the first coordinate direction and longitudinal of itself so that the entire surface of the work material can be reached by the tool head with the tool moving along straight or curved lines relative to the sheet of material.

Subsequent to the performance of the work operation the elongated sheet of material is typically advanced out of the plotter in a vertically downward direction towards the floor or other horizontal surface such as, for example, a table top. Often, the sheet materials being processed are somewhat stiff and therefore do not immediately collapse when the leading edge of the sheet material contacts an obstruction. Therefore, a problem sometimes occurs when the edge of the sheet material, as it is being fed out of the plotter, contacts a floor or other horizontal surface. When this happens, the sheet material, rather than simply collecting on the floor, tends to kink and may back up or send a shock wave through the sheet material to the particular area upon which the tool head is performing the work operation. This can detrimentally affect the operation of the tool head and thereby damage the item being made.

In addition to the foregoing, the speed at which the sheet material is fed out of the plotter is directly proportional to the magnitude of the shock wave that will be generated when the leading edge of the sheet material impacts the floor. Therefore, there is a current need for a means by which the plotting speed can be maximized, and the impact speed of the sheet material minimized.

Accordingly, it is the general object of the present invention to provide an apparatus which prevents kinking, or the generation of shock waves in a sheet material as it is being processed.

A more specific object of the present invention is to provide a device which decreases the speed at which the sheet material contacts a horizontal surface as it is advanced out of the plotter while maximizing the speed at which the sheet material is plotted.

SUMMARY OF THE INVENTION

The present invention meets these and other objects by providing, in one aspect, a device for retaining an elongated sheet material comprising a processing apparatus for performing work operations on the sheet material. The processing apparatus having a frame and an advancing means for feeding the sheet material in a first coordinate direction extending longitudinally of the sheet material through the processing apparatus. An elongated tool head support is carried by the frame and has a predetermined length. A tool head is slidably mounted to the support for movement along the support's length. A drive means is associated with the tool head for driving the tool head back and forth along the length of the support, and a retaining means is attached to the frame for retaining the sheet material as it is fed out of the processing apparatus thereby causing the sheet material to form a vertical loop such that when the sheet material contacts a horizontal surface, it will pivot about the vertical loop thereby preventing kinking or shock waves in the sheet material.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DETAILED DESCRIPTION OF THE PREFERRED EMBODIMENT

Figure 1:
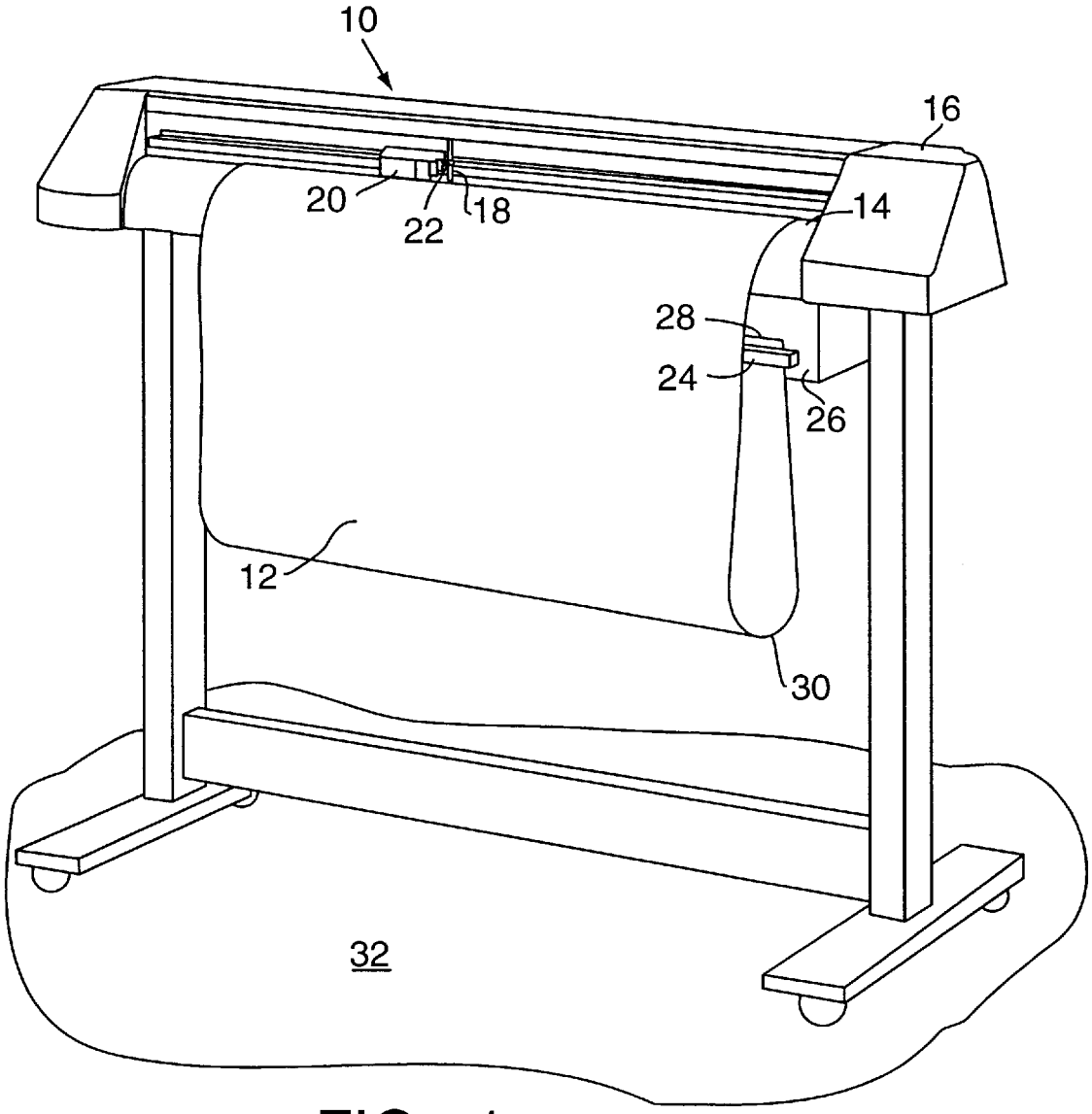
FIG. 1 is a perspective view of a processing mechanism and retaining means which forms part of the present invention.

Turning to the drawings and first referring to FIG. 1, the preferred embodiment of an apparatus there shown and generally designated as 10, is used for performing a work operation on a sheet material 12.

To perform a work operation on an elongated sheet material 12, the material is advanced in a first (x) coordinate direction longitudinal of itself through a processing apparatus 10 such as, for example, a drum plotter. While a drum plotter is shown, many other types of processing apparatus known to those skilled in the art may be substituted without departing from the broader aspects of the invention. In addition, various details of plotter construction and ancillary mechanisms concerned with plotter operation are well known in the art and need not be described herein as by themselves they form no part of the present invention. The plotter 10 includes a roller platen 14 rotatably mounted to a frame 16. In operation, the sheet material 12 passes over the roller platen 14 relative to at least one processing implement 18. The plotter 10 is further defined by at least one tool head 20 and at least one associated tool holder 22 rotatably mounted to the tool head 20. At least one web processing implement 18 is received in the tool holder 22 and rotatable relative to the tool head 20.

Figure 2:
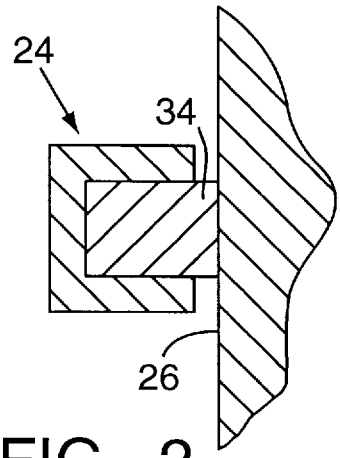
FIG. 2 is a sectional view of the retaining means shown in FIG. 1.

Turning now to FIGS. 1 and 2, a retaining means 24 is mounted to a frame portion 26. During operation, as the sheet material 12 is advanced out of the plotter 10, the leading edge 28 of the sheet material 12 is positioned within and held between the retaining means 24 and the frame portion 26. As the sheet material is advanced further out of the plotter 10, a vertical loop 30 is formed by the sheet material 12. The vertical loop 30 provides for approximately double the amount of sheet material 12 to be advanced out of the plotter 10 before the sheet material reaches the horizontal surface 32, than if the loop were not present. This causes the advancement rate of the sheet material to be half of what it would be without the loop. Therefore, since the advancement rate is cut in half, the impact force generated when the sheet material contacts a floor 32 or other horizontal surface will be greatly reduced. Additionally, because of the presence of the vertical loop 30, when the sheet material 12 is advanced out of the processing apparatus 10 to the point where it contacts a floor 32 or other surface, the loop will bow out at its sides, absorbing the impact and acting as a cushion thereby greatly reducing any shock waves generated in the sheet material. Accordingly, upon impact, the sheet material, rather than kinking will pivot about the vertical loop thereby further reducing the potential for generating shock waves in the sheet material.

Referring to FIG. 2, in the preferred embodiment, the retaining means 24 consists of at least one magnetic member 34. The leading edge 28 of the sheet material 12 is interposed between and held in communication with the magnetic member 34 and the frame portion 26. The frame portion 26 being composed of a suitable material, for example, iron or steel, such that the magnetic member 34 is magnetically attracted to and releasably held against the frame portion 26.

Figure 3:
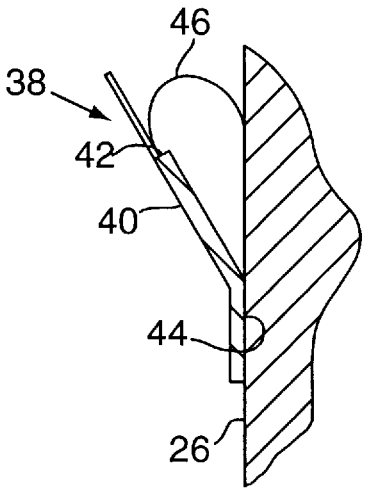
FIG. 3 is an alternate embodiment of the retaining means shown in FIG. 1.

Various different versions of the retaining means 24 may be used with the plotter 10 and the sheet material 12, one such other version is shown in FIG. 3. Referring to this figure the retaining means 38 there shown is generally similar in function to that of FIG. 2 but instead of relying on magnetics to establish the clamping force, this alternate embodiment employs a mechanical means to impart the requisite contact. The retaining means 38 consists of at least one elongated retaining member 40 having an upper surface 42 and a retaining surface 44. A biasing means 46 such as, for example a spring or piece of spring steel is interposed between and attached to the frame portion 26 and the retaining member upper surface 42 for urging the clamping surface 40 against the frame portion 26. During operation, the sheet material 12 is interposed between and held by the clamping surface 40 cooperating with the frame portion 26.

Figure 4:
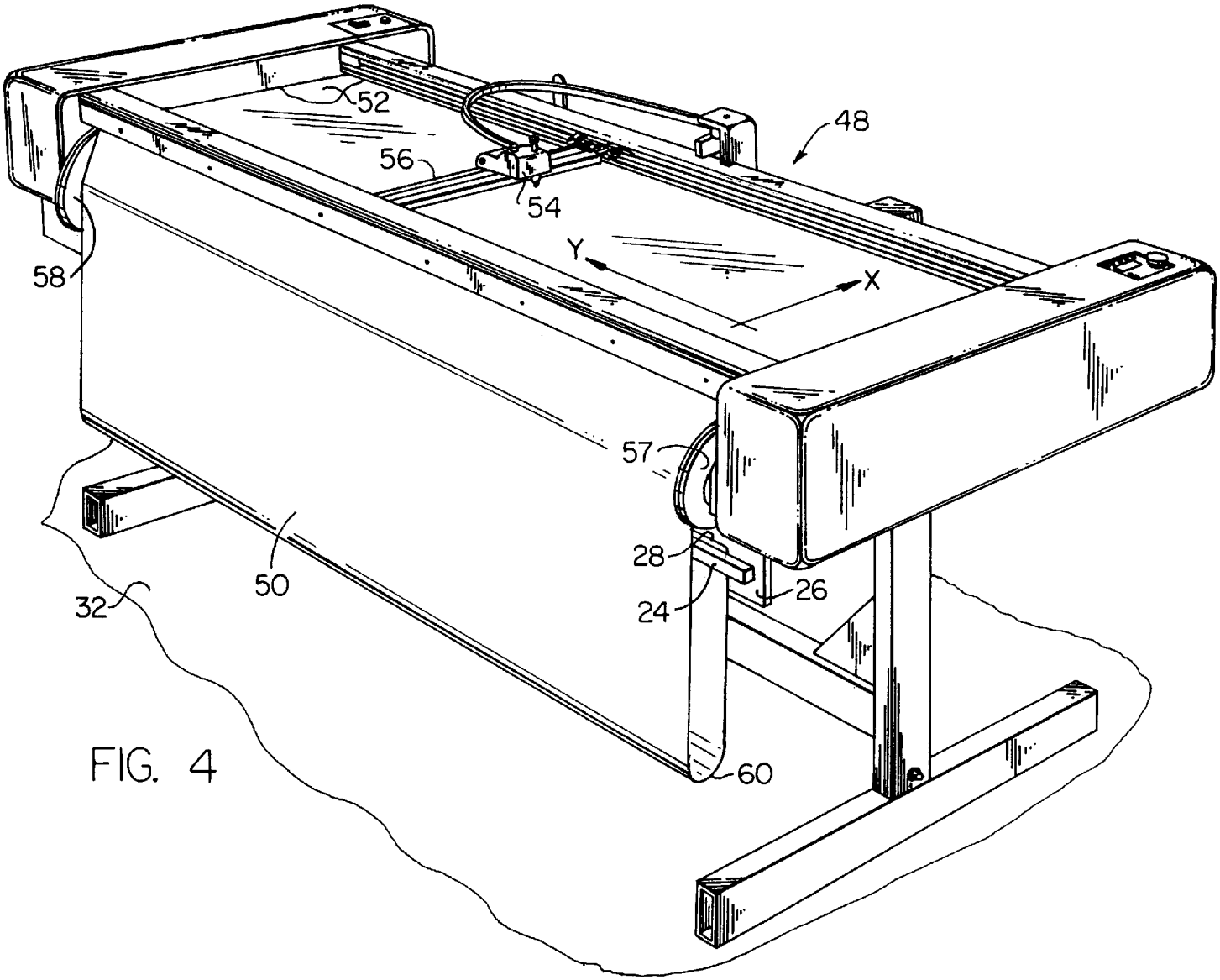
FIG. 4 is a perspective view of an alternative processing mechanism and retaining means which forms part of the present invention.

In another embodiment of the present invention shown in FIG. 4, the retaining means 24 can be used in connection with a flat bed type of material processing apparatus 48. In this type of device, a work operation is performed on the sheet material 50 as it rests on a flat work surface 52. During the performance of a work operation, the tool head 54 traverses the tool head support 56 back and forth in a first coordinate direction. The tool head support 56 traverses the flat work surface 52 in a second coordinate direction perpendicular to the first coordinate direction. Upon completion of a work operation, the sheet material 50 is advanced out of the material processing apparatus. When using a flat bed type of material processing apparatus, the shock waves caused by the impact of the sheet material with a floor or horizontal surface would not necessarily cause problems with the particular work operation being performed, however, they could cause difficulties with the sheet material advancing means 56 by for instance, causing the material to come off of the advancement sprockets 58. Therefore, similarly to the embodiment of the present invention shown in FIG. 1, the leading edge 28 of the sheet material 50 is positioned within and held between the retaining means 24 and the frame portion 26 of the frame. As the sheet material is advanced further out of the plotter 48, a vertical loop 60 is formed by the sheet material 50.

Figure 5:
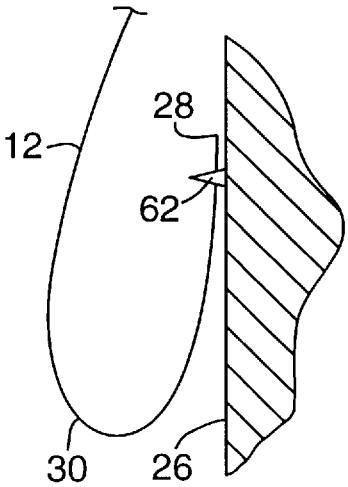
FIG. 5 is an alternate embodiment of the retaining means shown in FIG. 1.
Figure 6:
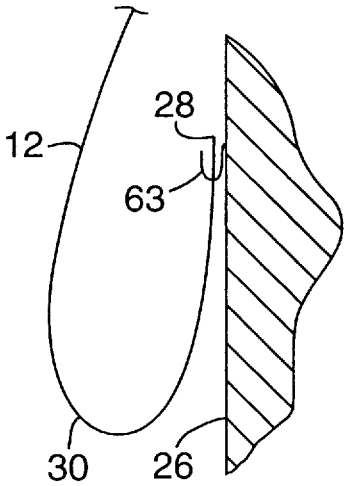
FIG. 6 is an alternate embodiment of the retaining means shown in FIG. 1.

Various different versions of the retaining means may be used with the plotter 10 and the sheet material 12, while the invention is not limited in this regard, four such other versions are shown in FIGS. 5 through 8. Referring to FIG. 5, the frame portion 26 includes a plurality of barbs 62 for gripping the sheet material 12. In operation, as the sheet material 12 is advanced out of the plotter 10, the leading edge 28 is positioned over the barbs 62 by the operator. The operator then applies sufficient pressure to the sheet material 12 to cause the barbs to puncture the sheet material causing it to be held in place, thereby allowing the aforementioned vertical loop 30 to be form as the sheet material is advanced out of the processing apparatus. While barbs are shown in FIG. 5, many other types of retaining means known to those skilled in the art may be substituted without departing from the broader aspects of the present invention. For example, hooks 63, FIG. 6, may be employed to retain the sheet material in the same manner as the previously described barbs 62, FIG. 5.

Figure 7:
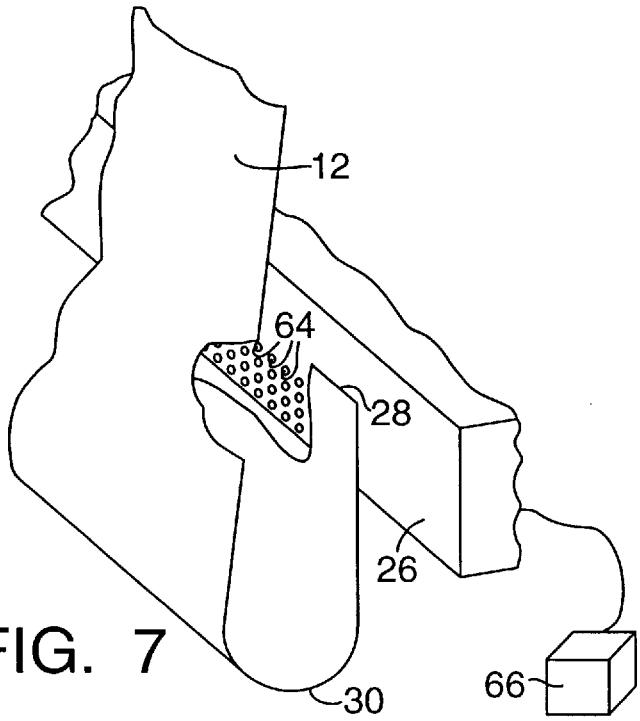
FIG. 7 is an alternate embodiment of the retaining means shown in FIG. 1.

FIG. 7 illustrates still a further embodiment of the retaining means 24 wherein vacuum is drawn through a plurality of apertures 64 extending through the previously described frame portion 26. During operation, as the sheet material 12 is advanced out of the plotter 10, a vacuum means 66 is employed to draw vacuum through the apertures 64. The leading edge 28 of the sheet material is positioned over the apertures 64 thereby allowing the vacuum means 66 to draw the sheet material 12 against the frame portion 26 thereby retaining the sheet material and allowing the vertical loop 30 to be formed.

Figure 8:
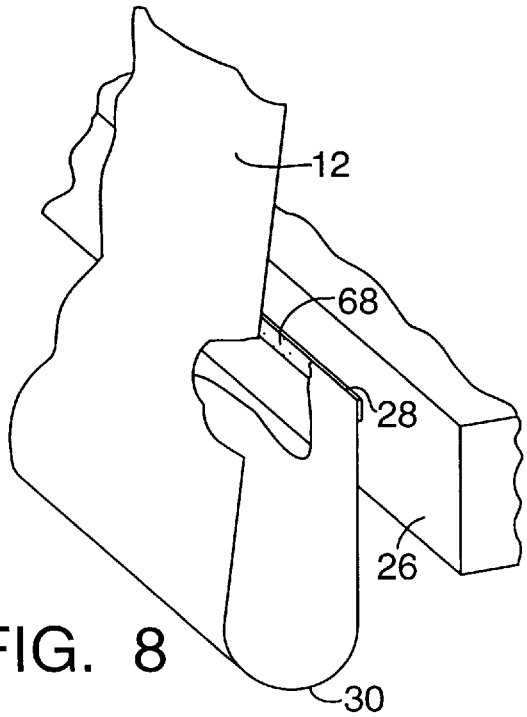
FIG. 8 is an alternate embodiment of the retaining means shown in FIG. 1.

In yet another embodiment of the present invention illustrated in FIG. 8, an adhesive strip 68 is attached to the frame portion 26 to retain the leading edge 28 of the sheet material 12. Similarly to the other retaining means 24 described herein, once the sheet material 12 is adhered to the adhesive strip a vertical loop 30 is formed as the sheet material is advanced out of the plotter 10.

While preferred embodiments have been shown and described, various modifications and substitutions may be made without departing from the spirit and scope of the invention. Accordingly, it is to be understood that the present invention has been described by way of example, and not by limitation.

We claim:

1. A processing apparatus for performing work operations on a sheet material comprising:

a frame positioned on an approximately horizontal surface;

advancing means for feeding an elongated strip of sheet material in a first coordinate direction extending longitudinally of said sheet material through said apparatus and onto said horizontal surface;

an elongated tool head support, carried by said frame and having a predetermined length;

a tool head slidably mounted to said support for movement along said length of said support for performing a work operation on said sheet material;

drive means, associated with said tool head for driving said tool head back and forth along the length of said support; and sheet material retaining means coupled to said frame above said horizontal surface adjacent to said advancing means and for retaining a leading edge of said sheet material, thereby causing said sheet material to form a vertical loop as it is fed out of said apparatus toward said horizontal surface such that when said sheet material contacts said horizontal surface, it will pivot about said vertical loop thereby preventing kinking, or shock waves from being generated in said sheet material.

2. A processing apparatus as defined by claim 1, wherein said retaining means includes:

at least one permanent magnet;

said frame includes a magnetic portion positioned above said horizontal surface and adjacent to said advancing means adapted to receive said permanent magnet; and wherein said at least one permanent magnet and said magnetic portion are adapted to receive said leading edge of said sheet material therebetween.

3. A processing apparatus as defined by claim 1, wherein:

said sheet material retaining means includes at least one elongated retaining member having, an upper surface and a sheet material retaining surface, pivotally coupled above said horizontal surface and adjacent to said advancing means; and biasing means interposed between and coupled to said frame and said retaining member upper surface for urging said sheet material retaining surface toward said frame and against said leading edge of said sheet material.

4. A processing apparatus as defined by claim 3, wherein said biasing means includes at least one spring.

5. A processing apparatus as defined by claim 3, wherein said biasing means includes at least one strip of spring steel positioned between said upper surface and said frame.

6. A processing apparatus as defined by claim 1, wherein said apparatus includes an approximately flat work surface, and said tool head moves along the length of said support in a first coordinate direction and said support moves in a second coordinate direction approximately perpendicular to said first coordinate direction.

7. A processing apparatus as defined by claim 1, wherein said sheet material retaining member includes a plurality of barbs carried by said frame and positioned above said horizontal surface adjacent to said advancing means for piercing said leading edge of said sheet material thereby retaining said leading edge on said barbs.

8. A processing apparatus as defined by claim 1, wherein said sheet material retaining member includes a plurality of hooks coupled to said frame and positioned above said horizontal surface adjacent to said advancing means for piercing said leading edge of said sheet material when said leading edge is positioned over said hooks and pressure is applied to said sheet material thereby retaining said leading edge on said hooks.

9. A processing apparatus as defined by claim 1, wherein said sheet material retaining member includes a plurality of apertures extending through said frame above said horizontal surface adjacent to said advancing means;

vacuum means coupled to said frame adjacent to said apertures for drawing vacuum through said apertures, such that when said leading edge of said sheet material is positioned over said apertures, said vacuum draws and retains said leading edge against said frame.

10. A processing apparatus as defined by claim 1, wherein said sheet material retaining member includes at least one adhesive strip coupled to said frame above said horizontal surface and adjacent to said advancing means for retaining said leading edge of said sheet material.

* * * * *